US009617755B2

(12) United States Patent
Peabody et al.

(10) Patent No.: US 9,617,755 B2
(45) Date of Patent: Apr. 11, 2017

(54) REINFORCED STRIKE ASSEMBLY

(71) Applicant: Hanchett Entry Systems, Inc., Phoenix, AZ (US)

(72) Inventors: Joshua T. Peabody, Phoenix, AZ (US); Francisco Figueroa-Del Pozo, Scottsdale, AZ (US); Ryan Matthew Sims, Mesa, AZ (US); Dominik Scheffler, Phoenix, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 10 days.

(21) Appl. No.: 14/828,950

(22) Filed: Aug. 18, 2015

(65) Prior Publication Data

US 2016/0053511 A1 Feb. 25, 2016

Related U.S. Application Data

(60) Provisional application No. 62/039,700, filed on Aug. 20, 2014.

(51) Int. Cl.

| | |
|---|---|
| ***E05B 15/02*** | (2006.01) |
| ***E05B 47/00*** | (2006.01) |
| *E05B 63/04* | (2006.01) |

(52) U.S. Cl.

CPC ..... *E05B 15/022* (2013.01); *E05B 47/0046* (2013.01); *E05B 63/042* (2013.01)

(58) Field of Classification Search

CPC ..... E05B 15/022

See application file for complete search history.

(56) References Cited

U.S. PATENT DOCUMENTS

| | | | | |
|---|---|---|---|---|
| 4,813,724 | A * | 3/1989 | Dietrich | E05B 15/022 292/341.12 |
| 7,021,684 | B2 * | 4/2006 | Orbeta | E05B 47/0046 292/201 |
| 7,438,335 | B1 * | 10/2008 | Uyeda | E05B 47/0046 292/341.15 |
| 8,047,585 | B1 | 11/2011 | Peabody et al. | |
| 8,454,063 | B2 | 6/2013 | David et al. | |
| 8,783,744 | B2 * | 7/2014 | Scheffler | E05B 47/0046 292/341.15 |
| 2005/0146143 | A1 * | 7/2005 | Lutfallah | E05C 17/48 292/153 |
| 2010/0078944 | A1 * | 4/2010 | Hirschoff | E05B 47/0047 292/198 |

* cited by examiner

*Primary Examiner* — Carlos Lugo
*Assistant Examiner* — Thomas Neubauer
(74) *Attorney, Agent, or Firm* — Ronald J. Kisicki, Esq.; Woods Oviatt Gilman, LLP

(57) ABSTRACT

A reinforced door strike assembly comprises a housing having an opening for admission and retraction of a door latch. At least one keeper arm is movably attached to the housing, and movable between a closed position where the opening is occluded and an open position where the door latch may be released from the opening. A reinforcing bracket is mounted to the housing and further defines the opening. The reinforcing bracket is coupled to the at least one keeper arm and to the housing to hold the at least one keeper arm in a plane perpendicular to the plane of the housing.

9 Claims, 5 Drawing Sheets

REINFORCED STRIKE ASSEMBLY

CROSS-REFERENCE TO RELATED APPLICATIONS

This Application claims the benefit of U.S. Provisional Application No. 62/039,700, filed Aug. 20, 2014.

TECHNICAL FIELD

The present invention relates to mechanisms for electrically locking a door in a frame; more particularly, to an electrical door strike assembly having movable keeper arms for selectively retaining and releasing an associated door latch, and most particularly to an electric door strike assembly including a reinforcement feature to oppose the forces placed on the keeper arms by the door latch.

BACKGROUND OF THE INVENTION

U.S. Pat. No. 8,454,063, entitled "Mode-Switchable Door Strike" (the '063 patent), the relevant disclosure of which is herein incorporated by reference, discloses an electric door strike assembly of the type forming the basis of this invention. As shown, latch portions 22 of keeper arms 18 are configured in the electric door strike assembly to be contacted by and withstand the force of an extended door latch when an attempt is made to open the door while the electric door strike assembly is in its locked mode.

When a wider keeper arm is needed in some installations in order to make contact with an extended door latch, a twisting force may be placed on the keeper arms and their associated pivots which may lead to unwanted strike assembly wear, and may even lead to an inoperative assembly thereby requiring reconstruction or replacement of the door strike, door latch or both.

What is needed in the art is an electric door strike assembly wherein the keeper arms and associated pivots are reinforced by a reinforcing bracket to minimize, and preferably eliminate the twisting force placed on the widened keeper arms.

It is a principal object of the present invention to provide a more durable electric door strike assembly.

SUMMARY OF THE INVENTION

Briefly described, an electric door strike assembly in accordance with the present invention comprises a housing having a central cutout portion with an opening adapted to receive a latch of a door. First and second keeper arms are pivotably mounted on opposite first and second sides of the opening and have latch portions extending across the opening, and have a first position occluding the opening, which position may be locked or unlocked, and a second position pivotable from the first position which allows the latch to be withdrawn from the opening past the latch portions. In one aspect of the invention, the latch portions of the keeper arms extend above the body of the housing such that they are susceptible to rotating or twisting out of proper alignment with the housing. To minimize, or preferably prevent such rotation or twisting, a reinforcing bracket is mounted to pivots of the keeper arms and to the housing so as to constrain the keeper arms in their plane perpendicular to the plane of the housing.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently preferred embodiments of the invention, and such exemplifications are not to be construed as limiting the scope of the invention in any manner.

DESCRIPTION OF THE PREFERRED EMBODIMENTS

Figure 1:
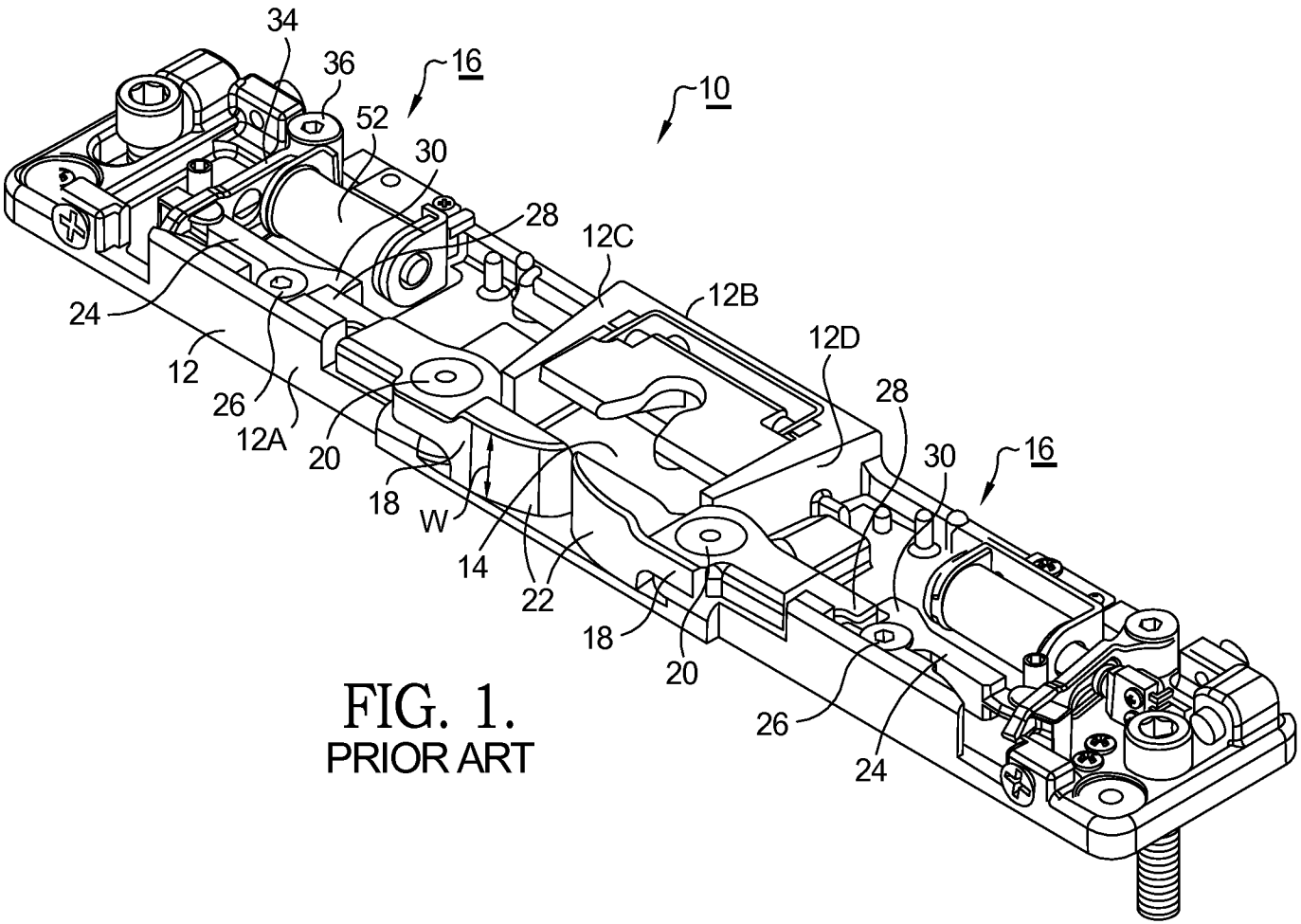
FIG. 1. PRIOR ART
FIG. 1 is an isometric view from the right front showing a prior art electric door strike assembly with the cover removed for clarity (cover is removed and not shown in all views herein)
Figure 2:
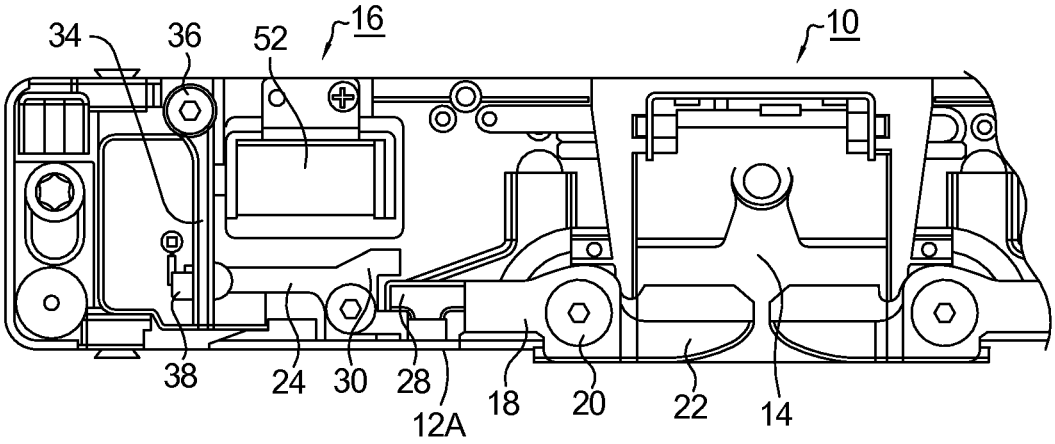
FIG. 2. PRIOR ART
FIG. 2 is a plan view of one end of the prior art electric door strike assembly shown in FIG. 1.
Figure 3:
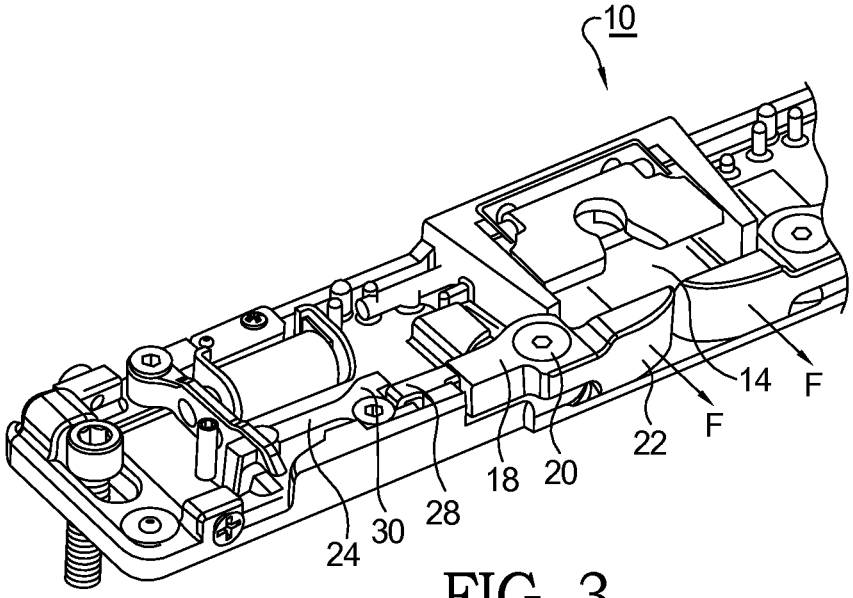
FIG. 3. PRIOR ART
FIG. 3 is an isometric view of one end of the prior art electric door strike assembly shown in FIG. 1.

Referring now to FIGS. 1 through 3, a prior art electric door strike assembly 10 comprises a housing 12 mountable to a door frame (not shown). The prior art electric door strike assembly 10 is to be regarded as exemplary in nature and does not serve to limit application of the present invention to embodiments solely thereto. The mounting of housing 12 may be either surface mounting or recessed mounting, as is well known in the prior art. A cover (not shown) protects the interior of housing 12 from tampering as well as from dirt, dust, and the like. Housing 12 includes an opening or cutout portion 14 adapted to receive a latch (not shown) of a door (not shown) as is also known in the prior art. Cutout portion 14 is generally defined by housing rear wall 12B and cutout side walls 12C, 12D.

The referenced prior art electric door strike assembly shown in FIG. 1 preferably comprises first and second mirror-image locking mechanisms 16 mounted to housing 12 and disposed symmetrically about cutout portion 14. For simplicity and clarity in presentation, general reference may be made to only one of the two mirror-image mechanisms 16, but such reference should be considered as being equally applicable to both except as otherwise noted. The use of a pair of keeper arms 18 is presently preferred over a single keeper arm as each keeper arm of the pair is subject to only half of any incoming force which, in turn, means that the strength of the device is essentially doubled.

Opposing keeper arms 18 are mounted at keeper arm pivots 20 positioned proximate the midpoint of keeper arms 18 and are positioned proximate to cutout portion 14. When keeper arms 18 are oriented in a closed position wherein their longitudinal axes are aligned in a plane generally parallel to the plane created by front housing wall 12A, latch portions 22 of arms 18 extend into and occlude cutout portion 14 thereby retaining the door latch within cutout portion 14. As is known in the prior art, when the door is moved closed, upon the door latch contacting the latch portions, the door latch retracts against a return spring force and is then free to be received by cutout portion 14, even when keeper arms 18 are in closed positions. That is, when the door is shut into a frame supporting strike assembly 10, the door latch retracts to allow passage past latch portions 22 but then snaps into cutout portion 14. Once in cutout portion 14 and when keeper arms 18 are in closed positions, the latch is trapped in cutout portion 14 and the door cannot be opened. Such keeper and strike action are well known in the art and the operation thereof will not be further discussed herein.

Keeper arms 18 are adapted to engage with transmission levers 24 mounted to housing 12 by transmission lever pivots 26. The axes of rotation of transmission lever pivots 26 are parallel to and aligned vertically with the axes of keeper arm pivots 20.

Prong 28 is positioned on each keeper arm 18 opposite latch portion 22. Prong 28 is received within a fork 30 positioned on a corresponding side of transmission lever 24 when keeper arm 18 is in a closed position.

Keeper arms 18 are resiliently urged to the closed position by springs (not visible) which may be mounted on pivots 20. One arm of each spring may engage a keeper arm 18 on its prong side and the other arm may engage a sidewall of cutout portion 14. Thus, when prongs 28 are released from forks 30, keeper arms 18 are held in the closed position only by the springs. To open the door, a user simply pushes against the door, causing the latch to rotate keeper arms 18 against the springs. Once the latch clears keeper arms 18, the keeper arms rotate back to the closed position under the urging of the springs. Further, to best position each transmission lever 24 to receive prong 28, a compression spring (not shown) may be mounted on one end thereof to fork 30 and at the other end thereof to housing 12 proximate fork 30. The compression springs urge transmission levers 24 rotatably away from housing 12 to best position fork 30 to receive prong 28.

A release lever 34 is used to control the motion of each transmission lever 24 from a rotatable state to a locked state. Release lever 34 is mounted at one end thereof to housing 12 by release lever pivot 36. The axes of rotation of release lever pivots 36 are parallel to but offset laterally from the axes of both keeper arm pivots 20 and transmission lever pivots 26. The other ends of release levers 34 engage ends 38 of transmission levers 24 opposite forks 30. Solenoid 52, when energized, moves release lever 34 into either engagement with or disengagement from transmission lever 24, thereby locking or unlocking the transmission lever so as to allow the keeper arm to move from a latch-blocking position under a force exerted by the extended door latch when the door is opened. The conjunctive operation of the solenoid, release lever, transmission lever and keeper arm is fully described in the incorporated-by-reference '063 patent and need not be described in further detail here.

Figure 4:
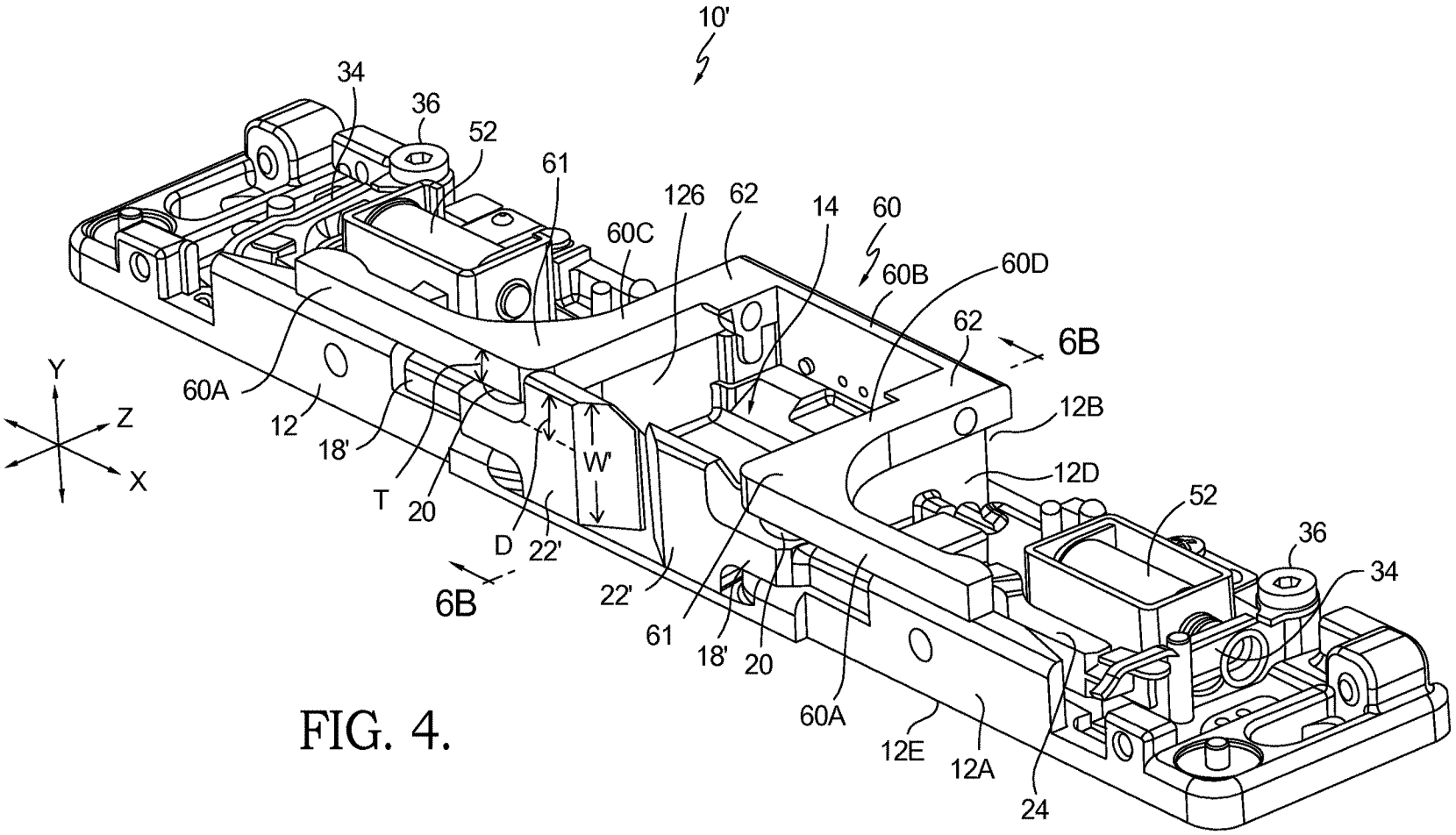
FIG. 4 is an isometric view from the right front showing an embodiment of the present invention.

In the electric door strike assembly described above, the width (W) (FIG. 1) of the latch portion 22 of the keeper arms are such that the door-opening force (F) (FIG. 3) placed on the keeper arms by the associated door latch when the keeper arms are locked are directed generally through keeper arm pivots 20 and the transmission lever and release lever with little or no twisting moment placed on the keeper arms and keeper arm pivots. However, in some instances, in order to accommodate an associated latch that would have a contact point with the keeper arms at a higher point on the keeper arm, the width (W') of the keeper arms must be increased as shown in FIG. 4. The resulting door-opening force (F') places a twisting moment (M) on the keeper arm pivots (FIG. 6B), Referring now to FIGS. 4-6B, an embodiment 10' of an electric door strike assembly of the present invention is shown, wherein all elements are identical with those of first embodiment 10 except latch portions 22' of opposing keeper arms 18' have a width W' greater than width W of latch portions 22 (see FIG. 1) and the provision of reinforcing bracket 60 which will be discussed in more detail below. Electric door strike assembly 10' is exemplary of a door strike amenable for including keeper arms 18' and is in no way meant to limit application keeper arms 18' solely to this embodiment. It is to be understood by those skilled in the art that keeper arms 18' may be proportioned to function within any suitable door strike device irrespective of how the solenoid connects to the keeper arm or arms.

In operation, similar to electric door strike assembly 10 described above, housing 12 includes a cutout portion 14 adapted to receive a latch (not shown) of a door (not shown) as is also known in the prior art. Cutout portion 14 is generally defined by housing rear wall 12B and cutout side walls 12C, 12D. Door strike assembly 10' includes opposing keeper arms 18' mounted at keeper arm pivots 20 positioned proximate the midpoint of keeper arms 18' and are positioned proximate to cutout portion 14. When keeper arms 18' are oriented in a closed position, for instance as shown in FIG. 4 wherein they lie in an x-y plane generally parallel to the plane created by front wall 12A and perpendicular to the x-z plane defined by bottom surface 12E of housing 12, latch portions 22' of arms 18' extend into and occlude cutout portion 14 thereby retaining the door latch within cutout portion 14.

Figure 6A:
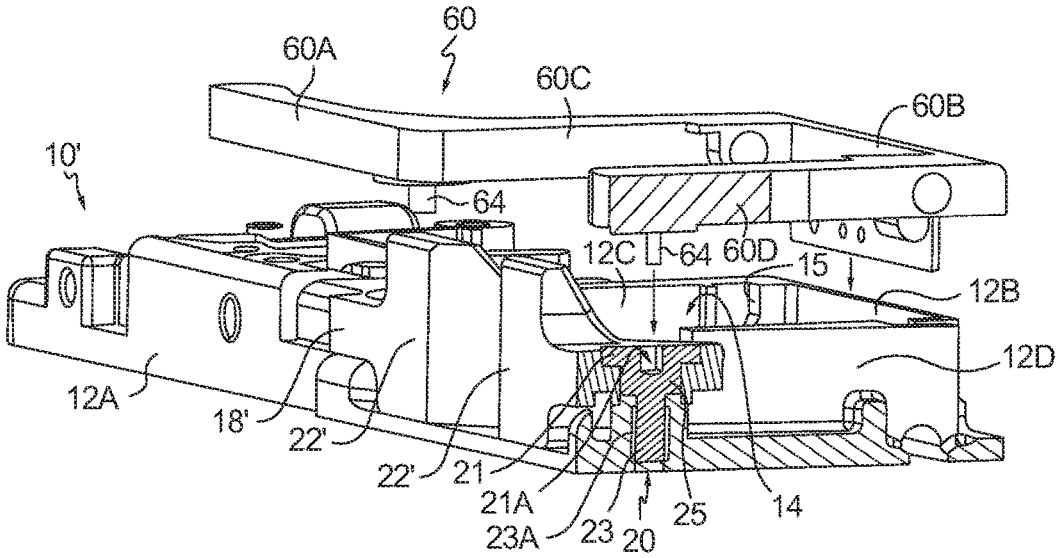
FIG. 6A is a cross-sectional view of the embodiment of the present invention taken generally along line 6A-6A in FIG. 5.
Figure 6B:
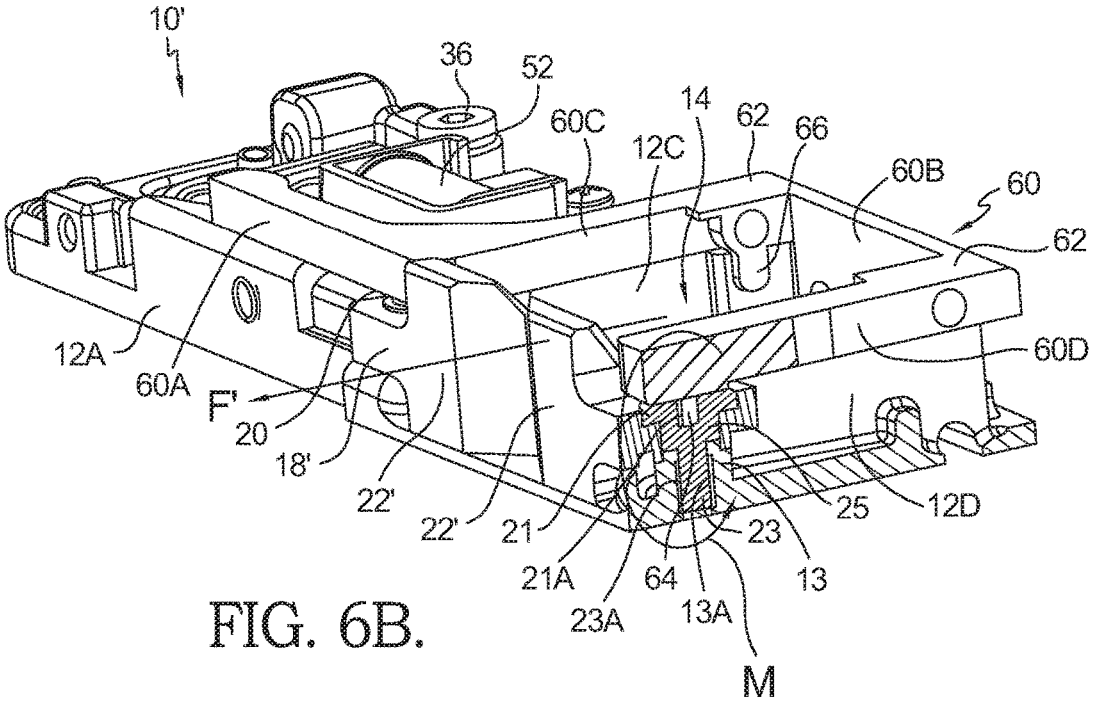
FIG. 6B is a cross-sectional view of the embodiment of the present invention taken generally along line 6B-6B in FIG. 4.

As can best be seen in FIGS. 6A and 6B, keeper arm pivots 20 each generally comprise a top flange portion 21 and a bottom threaded post portion 23. Bottom threaded post portion 23 includes integral male threads 23A which are configured to engage with corresponding female threads 13A within post member 13 which is integrally formed on housing 12 to secure keeper arm pivot 20 to housing 12. Top flange portion 21 includes a figured recess 21A configured to selectively receive a corresponding tool so as to enable tightening of bottom threaded post portion 23 to post member 13. Each keeper arm pivot 20 further includes a shaft portion 25 situated between top flange portion 21 and bottom threaded post portion 23. Shaft portion 25 is configured to engage keeper arm 18/18' as a bearing surface such that keeper arm 18/18' is constrained between top flange portion 21 and post member 13 while being able to pivot about shaft portion 25.

With continued reference to FIGS. 4-6B, mounting of keeper arms 18' requires the further mounting of reinforcing bracket 60. As discussed above, keeper arms 18' include latch portions 22' having a width, W', which is wider than width W of latch portions 22 of keeper arms 18 (see FIG. 1) generally by a distance D (FIG. 4). When keeper arms 18' are mounted within housing 12 of door strike 10', the increased width W' of latch portions 22' in combination with the various forces imposed upon keeper arm 18' by the door latch causes keeper arm 18' to rotate and twist about pivots 20 within the x-y plane when the keeper arms are in the closed position and a force F' is applied to latch portion 22'. This distortion generates unwanted torque upon keeper arm pivots 20. Beyond potentially damaging keeper arms 18' and keeper arm pivots 20, latch portions 22' may also not properly rotate about pivots 20 thereby preventing proper functioning of the door strike.

To alleviate, and preferably eliminate, any distortion of keeper arms 18' out of the x-y plane when in the closed position, reinforcing bracket 60 is mounted onto housing 12.

Figure 5:
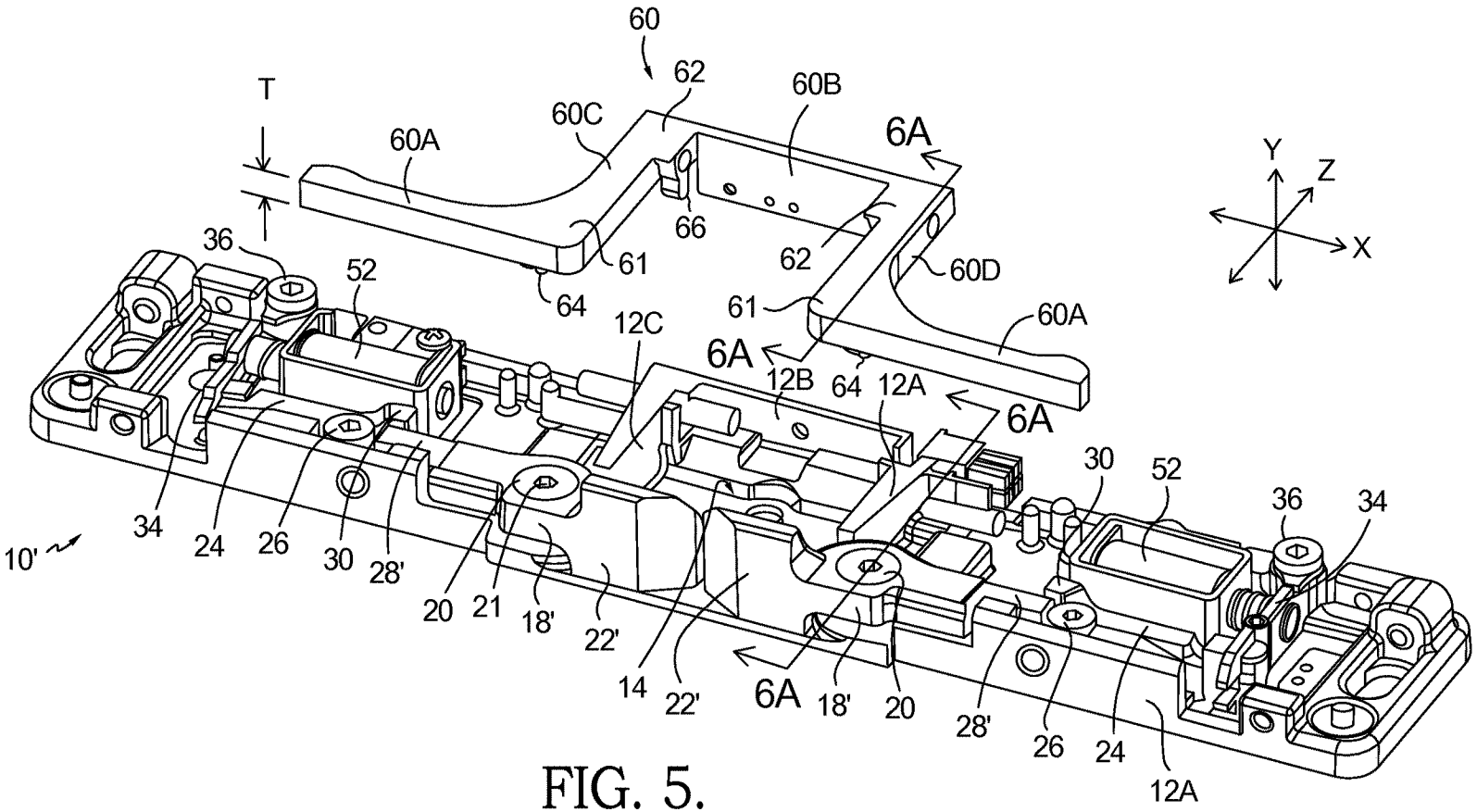
FIG. 5 is an isometric view from the right front of the embodiment shown in FIG. 4 with the support bracket removed from the housing.

As seen most clearly in FIGS. 5 and 6, reinforcing bracket 60 has a thickness T selected to be substantially similar to distance D and generally comprises front bracket arms 60A and bracket back 60B joined at either end by integral sidewalls 60C, 60D. Reinforcing bracket 60 is configured to rest upon housing front wall 12A, housing rear wall 12B and cutout sidewalls 12C, 12D so as to further define cutout portion 14. Reinforcing bracket 60 includes elbow regions 61 between arms 60A and sidewalls 60C, 60D and hip regions 62 between sidewalls 60C, 60D and bracket back 60B. Each elbow region 61 includes a respective downwardly extending finger 64, while each hip region 62 includes a respective downwardly extending foot 66. Fingers 64 are adapted to reside within figured recesses 21A of keeper arm pivots 20. Each foot 66 resides within a respective channel 15 disposed within cutout sidewalls 12C, 12D of housing 12. Once properly seated in place, fingers 64, feet 66 and bracket back 60B secure reinforcing bracket 60 to housing 12 and prevent movement of bracket 60 in the x-z plane. A housing cover (not shown) is secured to housing 12 and prevents upward movement of bracket 60 in the y direction.

With reinforcing bracket 60 secured in place within door strike 10', latch portions 22' are pivotally constrained within the x-y plane through bottom threaded post portion 23 of keeper arm pivot 20 and finger 64 of the reinforcing bracket. That is, keeper arms 18' are supported both above and below the pivot point (i.e. shaft portion 25) rather than solely below the pivot point as shown in embodiment 10 (FIGS. 1-3B). This additional support minimizes the twisting moment (M) placed on the keeper arm pivots and enables proper operation of the wider latch portions 22'.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A reinforced door strike assembly, comprising:

a) a housing having an opening for admission and retraction of a door latch, a wall, and a bottom surface disposed generally within an x-z plane;

b) at least one keeper arm pivotably attached to said housing, and movable parallel to said x-z plane between a closed position wherein said opening is occluded and an open position wherein said door latch may be released from said opening, wherein said at least one keeper includes a latch portion that occludes said opening in said closed position;

c) a keeper arm pivot configured to pivotably receive said at least one keeper arm on a shaft portion, wherein said keeper arm pivot includes a post portion having an axis, a first end, and a second end, wherein said axis is perpendicular to said x-z plane, wherein said first end is secured to said housing, and wherein said second end is disposed opposite said first end, wherein said second end includes a flange portion configured to restrain said at least one keeper arm in a direction perpendicular to said x-z plane, and wherein said shaft portion resides between said first end and said second end; and d) a reinforcing bracket directly coupled to said second end of said keeper arm pivot and to said wall of said housing to restrain said keeper arm pivot in a plane perpendicular to said x-z plane.

2. The reinforced door strike assembly in accordance with claim 1 further comprising:

d) a transmission lever pivotably attached to said housing for selectively engaging said at least one keeper arm and being rotatable to selectively lock and unlock said at least one keeper arm in said closed position;

e) an actuator connected to said housing; and f) a release lever rotatably attached to said housing at a first point and engaged with said transmission lever at a second point to selectively lock and unlock said transmission lever by rotation of said release lever by said actuator.

3. The reinforced door strike assembly in accordance with claim 1 wherein said reinforcing bracket includes a finger, wherein said second end of said keeper arm pivot defines a recess, and wherein said finger is received within said recess to directly couple said reinforcing bracket to said keeper arm pivot.

4. The reinforced door strike assembly in accordance with claim 3 wherein said reinforcing bracket includes:

a bracket back;

a first front bracket arm;

a second front bracket arm;

a first integral sidewall connecting said bracket back and said first front bracket arm; and a second integral sidewall connecting said bracket back and said second front bracket arm, wherein the intersection of said first integral sidewall and said first front bracket arm is an elbow region, and wherein said finger extends from said elbow region.

5. The reinforced door strike assembly in accordance with claim 4 wherein said reinforcing bracket includes a foot, wherein said wall defines a channel, and wherein said foot is received within said channel to secure said reinforcing bracket to said housing.

6. The reinforced door strike assembly in accordance with claim 5 wherein the intersection of said first integral sidewall and said bracket back is a hip region, and wherein said foot extends from said hip region.

7. The reinforced door strike assembly in accordance with claim 1 wherein said reinforcing bracket includes a foot, wherein said wall defines a channel, and wherein said foot is received within said channel to secure said reinforcing bracket to said housing.

8. The reinforced door strike assembly in accordance with claim 7 wherein said reinforcing bracket includes:

a bracket back;

a first front bracket arm;

a second front bracket arm;

a first integral sidewall connecting said bracket back and said first front bracket arm; and a second integral sidewall connecting said bracket back and said second front bracket arm, wherein the intersection of said first integral sidewall and said bracket back is a hip region, and wherein said foot extends from said hip region.

9. The reinforced door strike assembly in accordance with claim 1 wherein said latch portion includes a latch portion end that is distal from said bottom surface, wherein said latch portion has a width extending perpendicular from said x-z plane and terminating at said latch portion end, and wherein said second end of said keeper arm pivot is disposed between said latch portion end of said at least one keeper arm and said first end of said keeper arm pivot.

* * * * *